US005941631A

United States Patent [19]

Hsu

[11] Patent Number: 5,941,631

[45] Date of Patent: Aug. 24, 1999

[54] PENDENT LAMP STRUCTURE

[75] Inventor: Keen Hsu, Taichung, Taiwan

[73] Assignee: Bright Yin Huey Co., Ltd., Taichung, Taiwan

[21] Appl. No.: 09/181,549

[22] Filed: Oct. 29, 1998

[51] Int. Cl.[6] ..... F21S 1/04

[52] U.S. Cl. ..... 362/405; 362/363; 362/370; 362/454

[58] Field of Search ..... 362/234, 240, 362/362, 363, 368, 370, 404, 405, 406, 407, 408, 453, 454, 806

[56] References Cited

U.S. PATENT DOCUMENTS 1,389,831 9/1921 Israel ..... 362/405

3,622,779 11/1971 Lagin ..... 362/405

*Primary Examiner*—Y. Quach

*Attorney, Agent, or Firm*—Rosenberg, Klein & Bilker

[57] ABSTRACT

A pendent lamp structure includes a lamp housing, a top cap mounted on the top of the lamp housing, a threaded rod passing through the bottom of the lamp housing, a connecting bracket secured on the top end of the threaded rod, a bulb base secured on the connecting bracket, a plurality of bulbs mounted on the bulb base, a hanging rod having a bottom end passing through the connecting racket, a fixed head secured on the top end of the hanging rod and passing through the top cap, and a hanging ring secured on the fixed head and protruding outward from the top cap.

8 Claims, 6 Drawing Sheets

PENDENT LAMP STRUCTURE

BACKGROUND OF THE INVENTION

1. Field of the Invention

The present invention relates to a pendent lamp structure.

2. Description of the Related Prior Art

A conventional pendent lamp 10 is shown in FIGS. 1 and 2, and comprises a positioning base 11, a hanging rod 12 attached to the positioning base 11, a hanging head 13 mounted to the bottom of the hanging rod 12, a plurality of lamp bases 14 each attached to the hanging head 13, and a lamp housing 15 mounted around the hanging rod 12. However, the lamp housing 15 is provided for a decorative purpose only, and cannot provide an illumination effect to co-operate with the lamp bases 14, thereby limiting the versatility of the pendent lamp. The present invention has arisen to overcome the disadvantage of the conventional pendent lamp.

SUMMARY OF THE INVENTION

The primary objective of the present invention is to provide a pendent lamp structure comprising a lamp housing, a top cap mounted on the top of the lamp housing, a threaded rod passing through the bottom of the lamp housing, a connecting bracket secured on the top end of the threaded rod, a bulb base secured on the connecting bracket, a plurality of bulbs mounted on the bulb base, a hanging rod having a bottom end passing through the connecting bracket, a fixed head secured on the top end of the hanging rod and passing through the top cap, and a hanging ring secured on the fixed head and protruding outward from the top cap.

Further objectives and advantages of the present invention will become apparent after a careful reading of the detailed description with appropriate reference to the accompanying drawings.

DETAILED DESCRIPTION OF THE PREFERRED EMBODIMENTS

Figure 1:
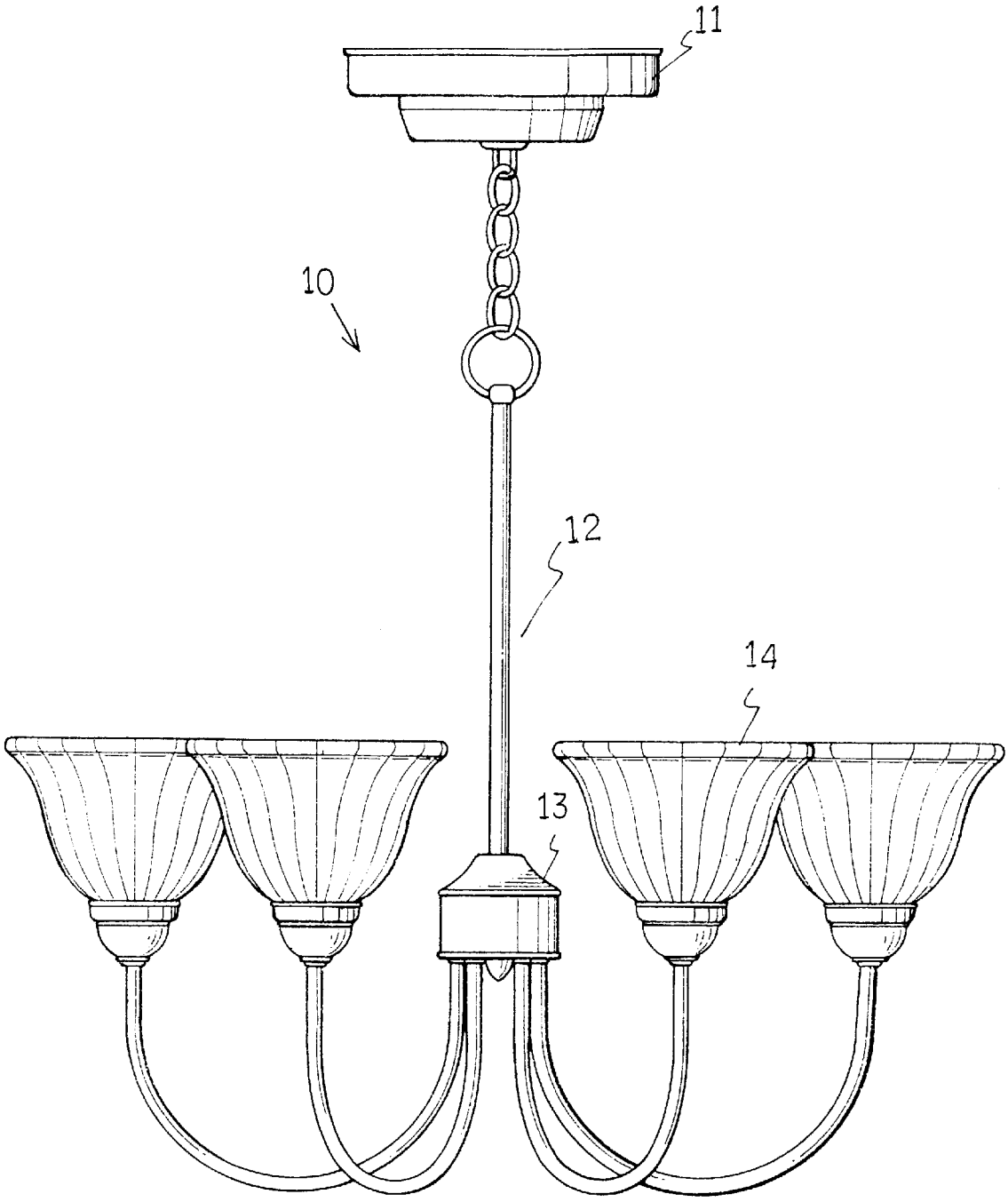
FIG.1 PRIOR ART
FIG. 1 is a front plan view of a conventional pendent lamp according to the prior art.
Figure 2:
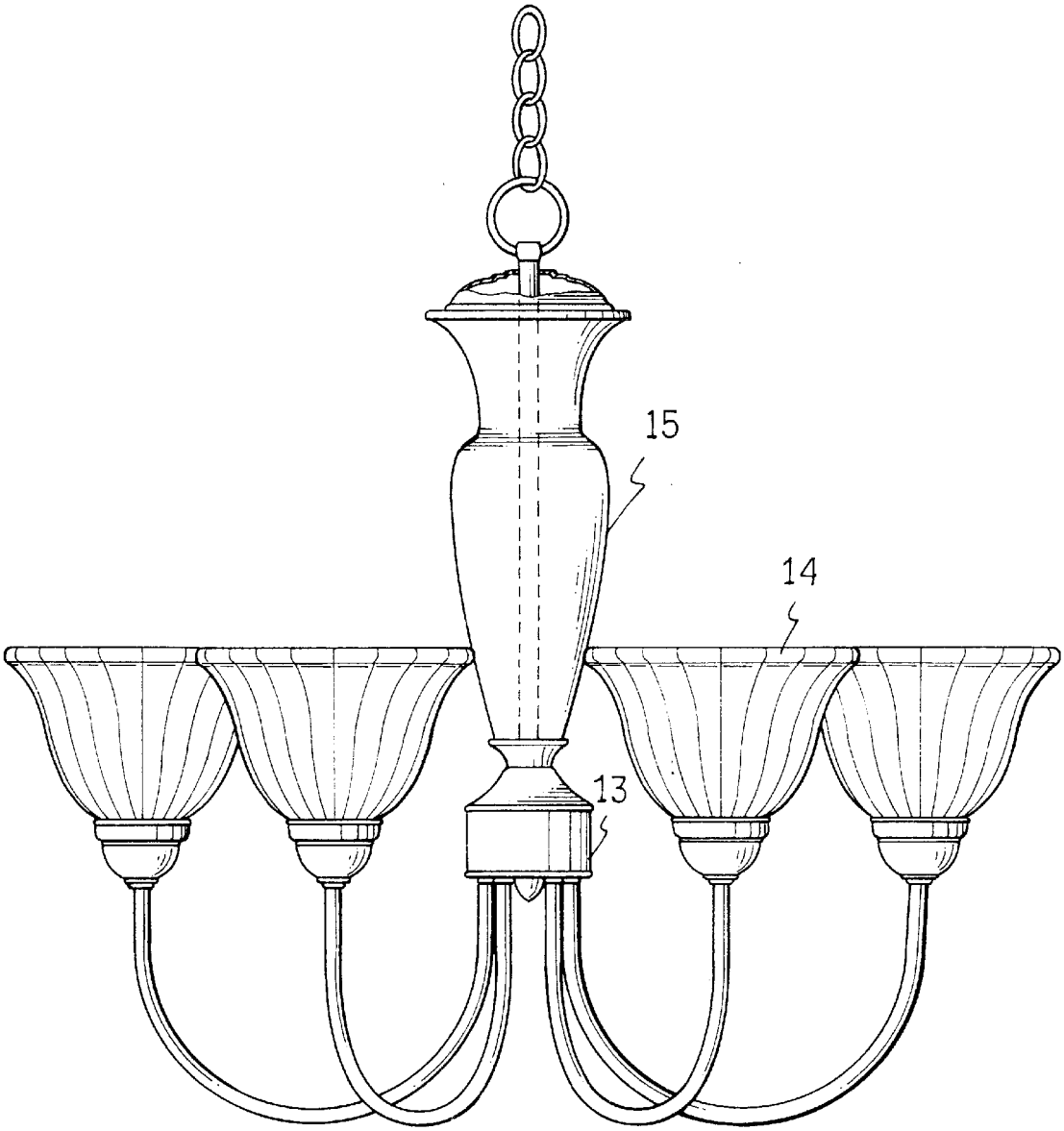
FIG. 2 PRIOR ART
FIG. 2 is a front plan view of the conventional pendent lamp according to the prior art.
Figure 3:
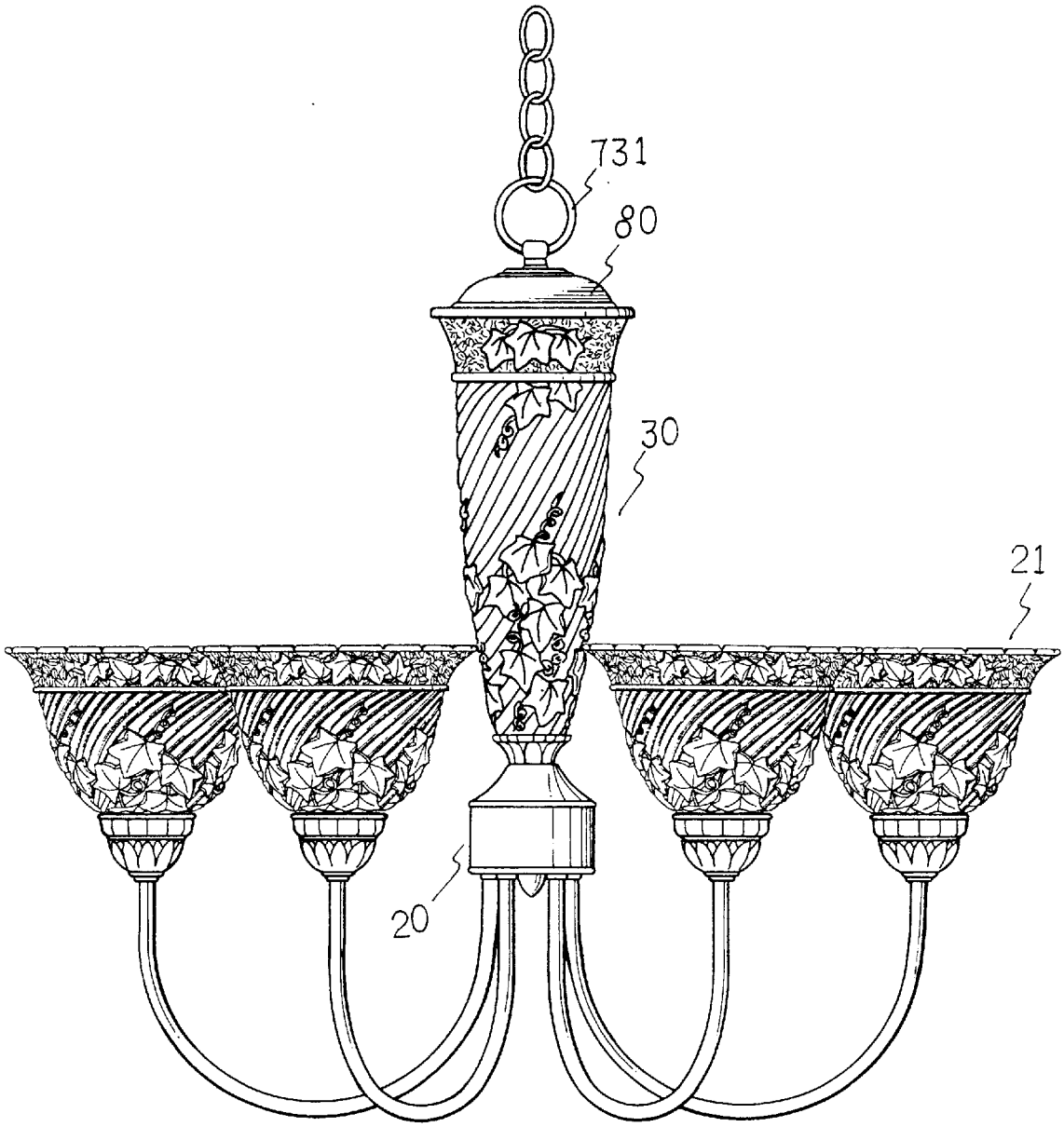
FIG. 3 is a front plan view of a pendent lamp structure according to the present invention.
Figure 4:
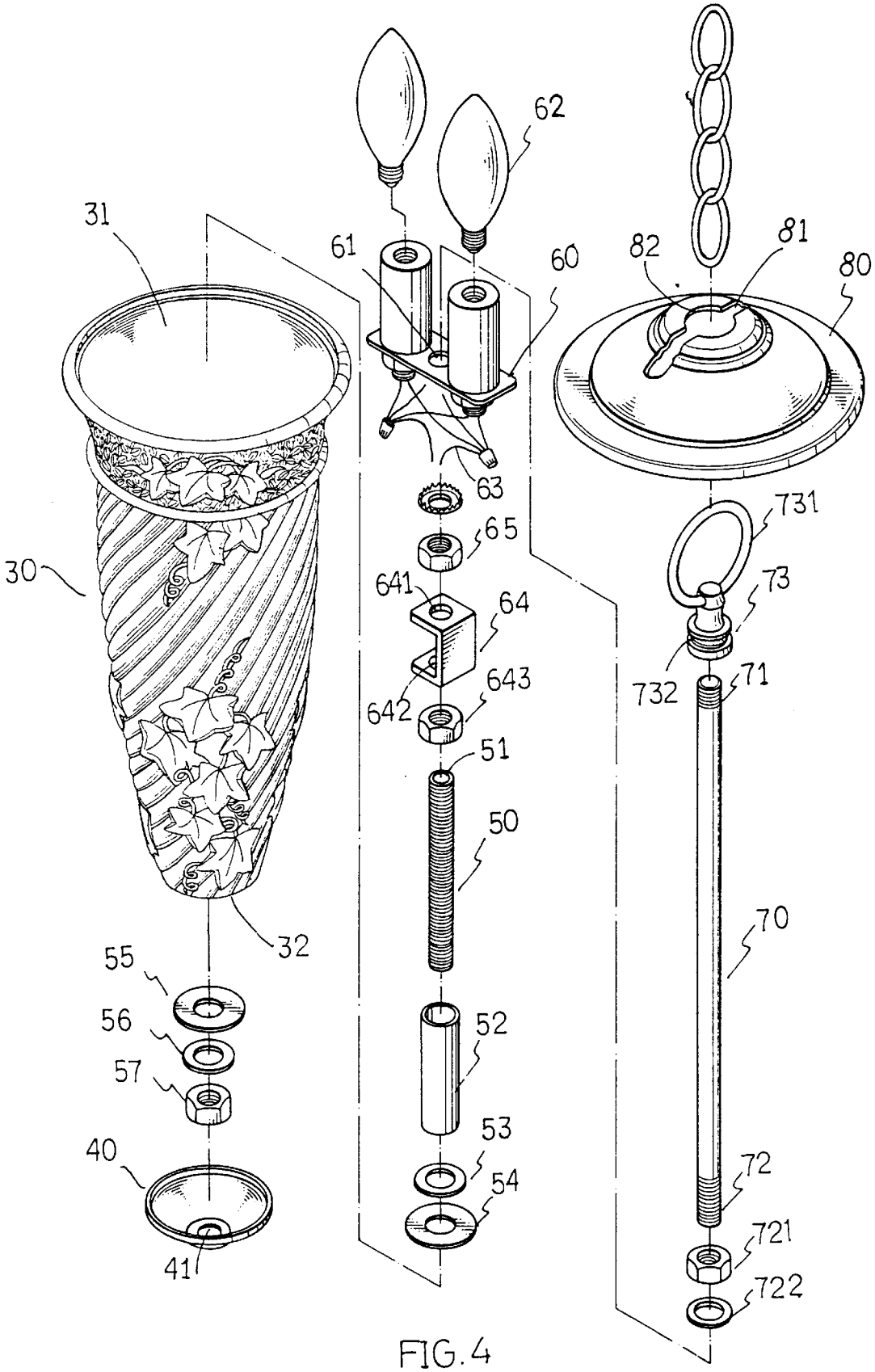
FIG. 4 is an exploded view of the pendent lamp as shown in FIG. 3.
Figure 5:
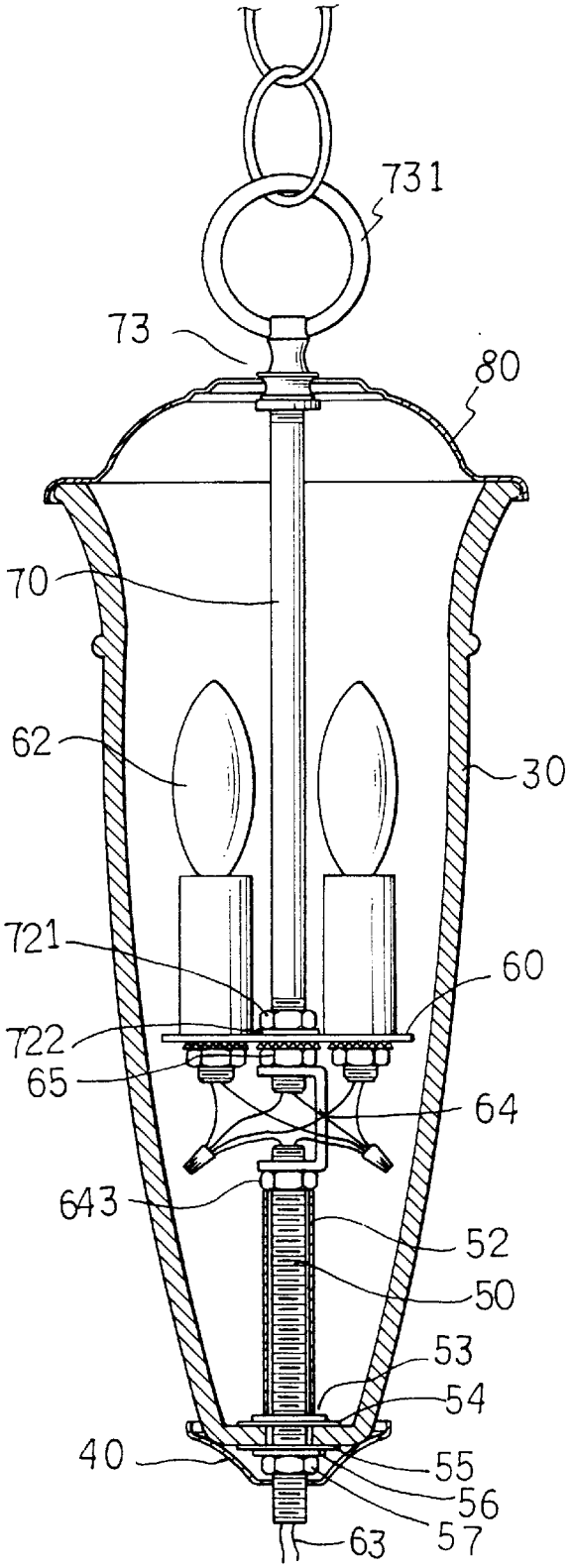
FIG. 5 is a front plan cross-sectional view of the pendent lamp as shown in FIG. 3.

With reference to FIGS. 3–5, a pendent lamp structure according to the present invention comprises a main lamp base, a hanging head 20 mounted to the bottom of the main lamp base, and a plurality of lamp bases 21 each attached to the hanging head 20.

The main lamp base comprises a lamp housing 30 forming an opening 31 therein and a hole 32 in the bottom thereof, a top cap 80 mounted on the top of the lamp housing 30 covering the opening 31, a threaded rod 50 passing through hole 32 formed in the bottom of the lamp housing 30, the hanging head 20 secured to the bottom end of the threaded rod 50, a U-shaped connecting bracket 64 secured on the top end of the threaded rod 50, a bulb base 60 secured on the connecting bracket 64, a plurality of bulbs 62 mounted on the bulb base 60, a hanging rod 70 having a bottom end passing through a hole 61 formed in the bulb base 60 and through the connecting bracket 64, a fixed head 73 threaded on an upper thread 71 formed on the top end of the hanging rod 70 and passing through the top cap 80, and a hanging ring 731 secured on the fixed head 73 and protruding outward from the top cap 80.

A bottom cap 40 is mounted on the bottom of the lamp housing 30 and formed with a hole 41 for passage of the threaded rod 50. A tube 52 is mounted on the outer wall of the threaded rod 50 which has a hollow hole 51 formed therethrough such that an electric wire 63 of the bulb base 60 may pass therethrough. Two upper washers 53 and 54 are mounted between the tube 52 and the bottom of the lamp housing 30, a nut 57 is threaded on the bottom end of the threaded rod 50, and two lower washers 55 and 56 are mounted between the bottom of the lamp housing 30 and the nut 57.

The connecting bracket 64 has a top portion formed with a top hole 641 receiving the bottom end of the hanging rod 70, and a bottom portion formed with a bottom hole 642 receiving the top end of the threaded rod 50.

A nut 643 is threaded on the top end of the threaded rod 50 for securing the connecting bracket 64 to the top end of the threaded rod 50, a nut 65 is threaded on a lower thread 72 formed on the bottom end of the hanging rod 70 for securing the connecting bracket 64 to the bottom end of the hanging rod 70, a nut 721 is threaded on the lower thread 72 of the hanging rod 70 for securing the bulb base 60 to the bottom end of the hanging rod 70, and a washer 722 is mounted between the nut 721 and the bulb base 60.

The fixed head 73 is formed with an annular groove 732 for receiving the top cap 80, and the top cap 80 is formed with a center hole 82 receiving the fixed head 73 and formed with an elongated cut 81 for passage of the hanging ring 731.

Accordingly, the pendent lamp structure according to the present invention is provided with a main lamp base located above the hanging head 20 so as to provide a decorative effect, thereby increasing the aesthetic quality of the pendent lamp structure. In addition, the main lamp base may provide an illumination function so as to work in concert with the lamp bases 21 surrounding the hanging head 20.

Figure 6:
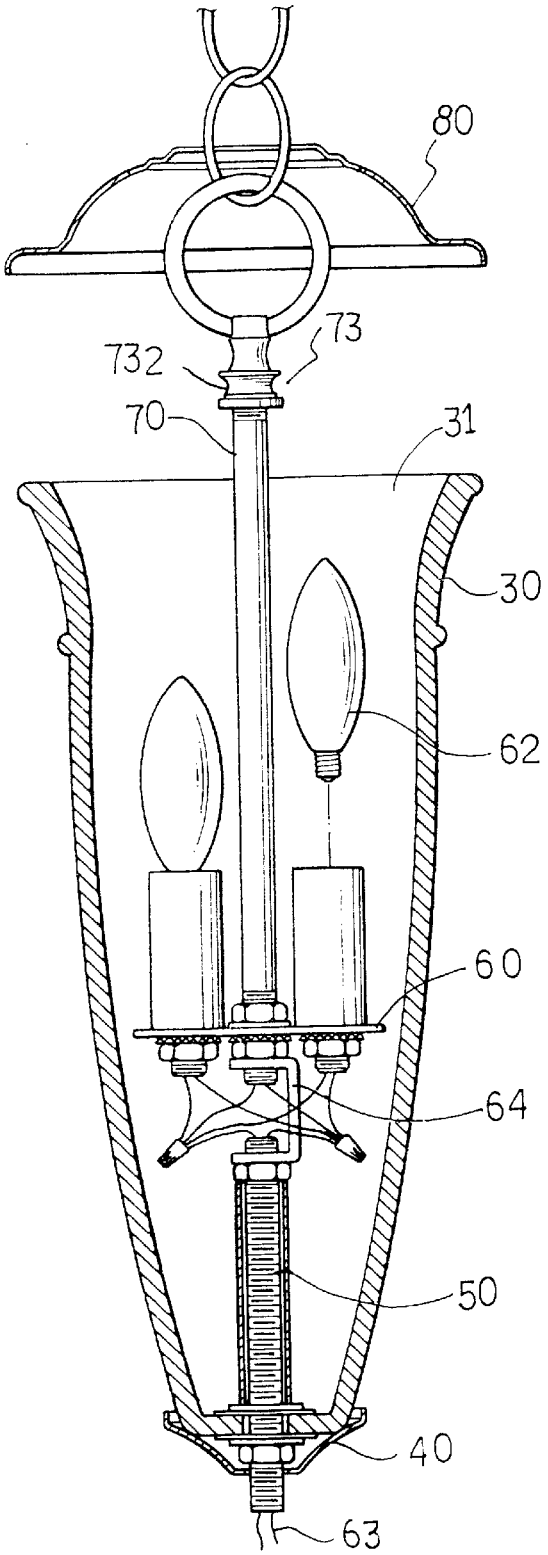
FIG. 6 is an operational view of the pendent lamp as shown in FIG. 5.

With reference to FIG. 6, the top cap 80 can be removed from the lamp housing 30, thereby exposing the opening 31 so as to replace the bulb 62 when it is worn out.

Although the present invention has been described with a certain degree of particularity, it is to be understood that the present disclose has been made by way of example only and that many other possible modifications and variations can be made without departing from the scope and spirit of the present invention.

I claim:

1. A pendent lamp structure comprising:

a lamp housing;

a top cap mounted on a top end of the lamp housing;

a threaded rod passing through a bottom end of the lamp housing;

a connecting bracket secured on a top end of the threaded rod;

a bulb base secured on the connecting bracket;

a plurality of bulbs mounted on the bulb base;

a hanging rod having a bottom end connecting to and passing through the connecting bracket and the bulb base;

a fixed head secured on the top end of the hanging rod and passing through the top cap; and a hanging ring secured on the fixed head and protruding outward from the top cap.

2. The pendent lamp structure as claimed in claim 1, wherein the threaded rod has a hollow hole formed therethrough, the bulb base has an electric wire passing through the hollow hole of the threaded rod, and the pendent lamp structure further comprises a tube mounted on an outer wall of the threaded rod.

3. The pendent lamp structure as claimed in claim 1, wherein the connecting bracket has a U-shaped cross-section and has a top portion formed with a top hole receiving the bottom end of the hanging rod, and a bottom portion formed with a bottom hole receiving the top end of the threaded rod, and the pendent lamp structure further comprises a first nut mounted on the bottom end of the hanging rod for securing the connecting bracket to the bottom end of the hanging rod, and a second nut mounted on the top end of the threaded rod for securing the connecting bracket to the top end of the threaded rod.

4. The pendent lamp structure as claimed in claim 1, wherein the fixed head is formed with an annular groove.

5. The pendent lamp structure as claimed in claim 1, wherein the top cap is formed with a center hole receiving the fixed head.

6. The pendent lamp structure as claimed in claim 1, wherein the top cap is formed with an elongated cut for passage of the hanging ring.

7. The pendent lamp structure as claimed in claim 1, further comprising a bottom cap mounted on the bottom end of the lamp housing and formed with a hole for passage of the threaded rod.

8. The pendent lamp structure as claimed in claim 1, further comprising a nut mounted on the bottom end of the hanging rod for securing the bulb base to the bottom end of the hanging rod.

* * * * *